US007856925B2

(12) United States Patent
Schäfer

(10) Patent No.: US 7,856,925 B2
(45) Date of Patent: Dec. 28, 2010

(54) METHOD FOR THE ARRANGEMENT OF PRINTING BLOCKS ON A PLATE CYLINDER OF A PRINTING MACHINE

(75) Inventor: Karl Robert Schäfer, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 3 days.

(21) Appl. No.: 12/448,873

(22) PCT Filed: Jul. 10, 2008

(86) PCT No.: PCT/EP2008/058958

§ 371 (c)(1),
(2), (4) Date: Jul. 13, 2009

(87) PCT Pub. No.: WO2009/016011

PCT Pub. Date: Feb. 5, 2009

(65) Prior Publication Data

US 2010/0043660 A1 Feb. 25, 2010

(30) Foreign Application Priority Data

Jul. 30, 2007 (DE) ..... 10 2007 035 689

(51) Int. Cl.
*B41F 27/12* (2006.01)

(52) U.S. Cl. ..... 101/477; 101/481; 101/486

(58) Field of Classification Search ..... 101/477, 101/481, 485, 486, DIG. 36
See application file for complete search history.

(56) References Cited

U.S. PATENT DOCUMENTS 5,806,431 A 9/1998 Muth
6,868,783 B2 3/2005 Dufour et al.
7,497,163 B2 3/2009 Roth

FOREIGN PATENT DOCUMENTS

| | | | |
|---|---|---|---|
| DE | 102 38 106 | A1 | 3/2004 |
| DE | 10 2004 052 020 | A1 | 5/2006 |
| DE | 10 2005 039 773 | A1 | 3/2007 |
| DE | 10 2005 044 223 | A1 | 3/2007 |
| EP | 0 808 714 | B1 | 11/1997 |
| EP | 1 291 175 | A1 | 3/2003 |
| EP | 1 645 414 | A1 | 4/2006 |

*Primary Examiner*—Leslie J Evanisko
(74) *Attorney, Agent, or Firm*—Jones, Tullar & Cooper, P.C.

(57) ABSTRACT

A plurality of printing blocks are placed on a plate cylinder of a printing machine. Each of these printing blocks is located at one of a plurality of mounting locations which are located adjacent each other in an axial direction of the plate cylinder. Each of these printing blocks is stored in a storage device which includes storage positions that are located adjacent to, and offset from each other at a fixed distance in the axial direction of the plate cylinder, prior to the arrangement of the printing blocks at one of the mounting locations of the plate cylinder. The plate cylinder and/or the storage device are displaced axially relative to each other by the operation of a positioning device. That displacement arranges a printing block to be arranged on the plate cylinder at a mounting location which is situated adjacent the mounting location of another printing block, which is already located there or what is still to be located there, at a distance which is reduced relative to a distance between two adjacent storage positions of the storage device.

25 Claims, 2 Drawing Sheets

METHOD FOR THE ARRANGEMENT OF PRINTING BLOCKS ON A PLATE CYLINDER OF A PRINTING MACHINE

CROSS-REFERENCE TO RELATED APPLICATIONS

This application is the U.S. national phase, under 35 U.S.C. 371, of PCT/EP2008/058958, filed Jul. 10, 2008; published as WO 2009/016011 A1 on Feb. 5, 2009 and claiming priority to DE 10 2007 035 689.9 filed Jul. 30, 2007, the disclosures of which are expressly incorporated herein by reference.

FIELD OF THE INVENTION

The present invention is directed to a method for arranging printing formes on a forme cylinder of a printing press. The printing formes are arranged in mounting positions located side by side axially in the direction of the forme cylinder. Prior to being so arranged, the printing formes are each stored in a storage position of a storage device that is provided with a plurality of such storage positions which are also arranged side by side in the axial direction of the forme cylinder.

BACKGROUND OF THE INVENTION

A device for arranging printing formes on a forme cylinder of a printing press is known from DE 10 238 106 A1. A storage device for use in storing printing formes is displaceable, as a complete unit, in the axial direction of the forme cylinder, relative to printing forme mounting positions which are arranged side by side on the forme cylinder.

A method of arranging manipulator heads to be movable in the axial direction of the forme cylinder is known from DE 10 2004 052 020 A1. This device is usable to position printing formes in relation to a preset lateral register, and to simultaneously change printing formes that are to be arranged side by side in the axial direction.

A method of arranging printing formes that will be arranged on a forme cylinder side by side in a storage device is known from DE 10 2005 039 773 A1. The printing formes are spaced the same distance from one another as the printing formes that are arranged side by side on the forme cylinder in its axial direction, and keep this spacing as close as possible.

A device that uses a transport assembly to axially position printing plates during mounting on a cylinder of a rotary printing press is known from EP 808 714 B1. An arrangement is provided for positioning the printing plate on the cylinder, in a position on a cylinder section that is assigned to the printing plate. That position is preselected from a plurality of positions lying axially side by side. A plurality of stops or a plurality of sensors are assigned to a printing plate that is assigned to a specific cylinder section.

SUMMARY OF THE INVENTION

The object of the present invention is to provide a method for arranging printing formes on a forme cylinder of a printing press.

The object is attained in accordance with the present invention by the provision of a plurality of printing formes that can be arranged side by side, in an axial direction of the forme cylinder, in a plurality of mounting positions. Before each forme is arranged in one of these mounting positions, it was stored in a storage position of a storage device that is provided with a plurality of such storage positions which have been arranged side by side in the axial direction of the forme cylinder and which are spaced at a fixed distance from each other. One of the storage device and the forme cylinder can be moved axially with respect to the other along the adjustment path.

The benefits to be achieved with the present invention consist especially in that, despite the provision of a fixed spacing between adjacent, side-by-side storage positions in the storage device, with that fixed spacing being determined by the configuration of the storage device, printing formes which are stored in or on these storage positions can be positioned, nearly without gaps, in adjacent, side-by-side mounting positions on the forme cylinder. A plurality of individual printing formes can thus be assembled in the axial direction of the forme cylinder to form a quasi panoramic printing forme. The respective print images of the individual printing formes are thereby combined in a mosaic fashion to create one at least nearly unified print image. In the most extreme case, this panoramic printing forme, which is comprised of a plurality of individual printing formes, in accordance with the present method, can comprise all of the printing formes which are arranged side by side axially on the forme cylinder. In an arrangement having six or eight printing formes that are positioned side by side, for example, the axial length of the forme cylinder is typically from 1,800 mm to 2,400 mm, for example. A panoramic printing forme, which would be configured as a single piece, would have to have this measurement as its width, thus making it highly unwieldy. The method in accordance with the present invention, which places the print images of individual printing formes in a row without a disruptive seam if at all possible, accordingly substantially facilitates the handling of otherwise very wide panoramic printing formes, which very wide panoramic printing formes are also highly susceptible to damage caused by bending or undesirable irregularities, for example. The method of the present invention can be fully automated. Storage devices, which are provided in a printing press for storing printing formes to be arranged on the relevant forme cylinder, can be utilized without modification.

BRIEF DESCRIPTION OF THE DRAWINGS

A preferred embodiment of the present invention is represented in the set of drawings and will be specified in greater detail in what follows. The drawings show.

DESCRIPTION OF THE PREFERRED EMBODIMENT

Figure 1:
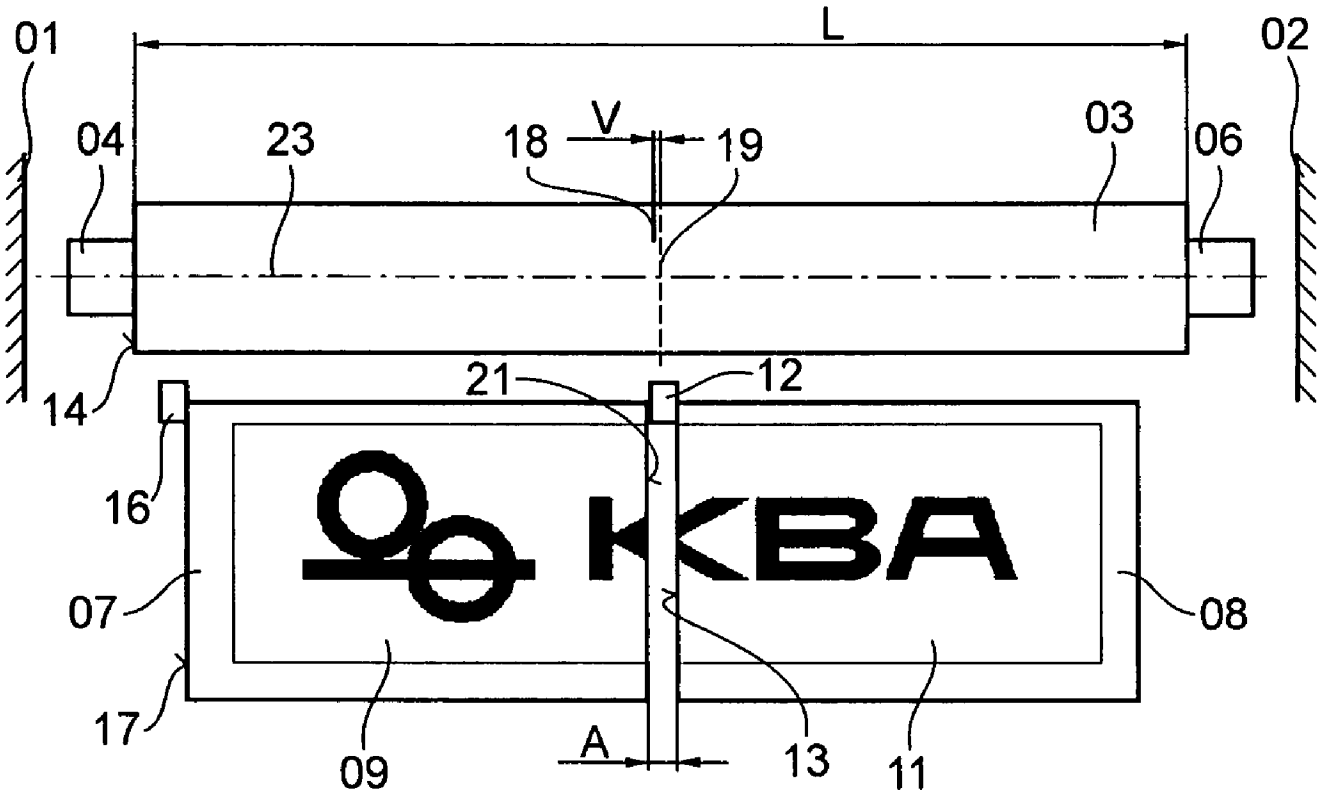
FIG. 1 an arrangement of a forme cylinder and a storage device for storing printing formes and being situated between two frame walls of a printing press.

Referring initially to FIG. 1, there may be seen, by way of example, a forme cylinder 03 of a printing press, such as, for example, a forme cylinder 03 of a printing press that operates using a planographic printing process, and preferably an offset printing process. The forme cylinder 03 is arranged between two parallel frame walls 01; 02 of the printing press. The printing press can be embodied as a rotary printing press or as a sheet-fed printing press. The printing press is preferably embodied as a newspaper printing press. The printing press typically has a plurality of printing couples, for example, with each such printing couple being configured with a forme cylinder 03 according to FIG. 1. Each such forme cylinder 03 cooperates with a transfer cylinder, for example, which is not specifically shown in FIG. 1. A plurality of printing blankets, for use in transferring an ink image to a print substrate, for example, are arranged side by side on the circumferential surface of each such transfer cylinder in its axial direction. An inking unit, which is also not specifically shown here, is also assigned to the forme cylinder 03, optionally along with a dampening unit, also not specifically shown. The forme cylinder 03 has no register stop.

The forme cylinder 03, which is part of one of the printing couples of the printing press, is rotatably mounted on journals 04; 06 in, or on the frame walls 01; 02. The forme cylinder 03 can preferably be rotationally driven by a drive, which is also not specifically shown, which drive is assigned exclusively to that forme cylinder 03. The forme cylinder 03 has a circumferential surface that can be loaded with, or provided with a plurality of plate-type, flexible printing formes 07; 08. A length L of the circumferential surface of the forme cylinder 03 is from 1,800 mm to 2,400 mm in the axial direction of the forme cylinder 03, for example. In the operating status of the forme cylinder 03, as shown in FIG. 1, it has not yet been loaded with printing formes 07; 08. In the interest of simplicity, FIG. 1 through 4 show only two printing formes 07; 08 which are to be arranged side by side in the axial direction of the forme cylinder 03. It will be understood that four, six or eight printing formes 07; 08 can be arranged side by side on the circumferential surface of the forme cylinder 03 by using the same method in accordance with the present invention, as will be described below. Each of the printing formes 07; 08 is to be arranged at a specific mounting position on the circumferential surface of the forme cylinder 03. The number of the mounting positions, which are arranged side by side axially on the circumferential surface of the forme cylinder 03, is the same as the number of printing formes 07; 08 that are to be arranged side by side on the circumferential surface of the forme cylinder 03. A plurality of printing formes 07; 08, such as, for example two such printing formes 07; 08, can also be arranged one in front of another on the forme cylinder 03 in its circumferential direction. In this way, a plurality of mounting positions, such as, for example, two such mounting positions, are provided, one in front of another, in the circumferential direction of the forme cylinder 03 at each respective axial mounting position of the forme cylinder 03. Thus, the circumferential surface of each forme cylinder 03 can be loaded with, for example four or with six printing formes 07; 08 in the axial direction of the forme cylinder 03 and with two printing formes 07; 08 in its circumferential direction.

Each of the printing formes 07; 08, which is to be arranged on the circumferential surface of the forme cylinder 03, has a print image 09; 11, which print image 09; 11, in each case, applied to a working surface of the respective printing forme 07; 08 prior to the arrangement of the respective printing forme 07; 08 on the forme cylinder 03. Such a print image application can be accomplished, for example, in an imaging device that is supplied with data from a preprint stage. The positioning of the print image 09; 11, during the process in which the imaging device applies the respective print image 09; 11 to the working surface of the respective printing forme 07; 08, can be variably selected using a preferably electronic control unit. The specific positioning of each print image 09; 11 on its respective printing forme 07; 08 can be determined, as needed, for the purpose of executing a specific print order.

The printing formes 07; 08 are each arranged in individual storage positions of a storage device before being taken from the storage device and being arranged in the mounting positions respectively assigned to them on the forme cylinder 03. The storage positions of the storage device are placed in functional connection with the mounting positions of the forme cylinder 03. In a preferred embodiment of the present invention, the storage device, with its respective storage positions, is located in a stationary position between the opposite frame walls 01; 02, at least once a functional connection between its storage positions and the side-by-side mounting positions of the forme cylinder 03 has been established. If a plurality of printing formes 07; 08 are to be arranged one in front of another in the circumferential direction of the forme cylinder 03, the storage device, which is assigned to the respective forme cylinder 03, preferably has a plurality of storage positions that are assigned to the respective axial positions of the forme cylinder 03.

The plurality of side-by-side storage positions in the storage device are arranged spaced from one another by a fixed, unmodifiable, distance A. As depicted schematically in FIG. 1, the distance A is determined by the configuration of the storage device and measures between 3 mm and 10 mm, for example, and preferably is approximately 5 mm. A stop 12, which is permanently connected to the storage device, is provided in the space which is formed by the distance A between adjacent storage positions of the storage device, for example. An edge 13 of a printing forme 08 which is to be supplied to the forme cylinder 03, which edge 13 is aligned parallel to its intended direction of conveyance, strikes against stop 12 by virtue of a force which is acting on this printing forme 08 and which is directed against this stop 12 in the axial direction of the forme cylinder 03, before and/or during the supply of that printing forme 08 to the forme cylinder 03. During the process of supplying that printing forme 08 from its storage position in the storage device to the surface of the forme cylinder 03, the edge 13 of the printing forme 08 can be guided along the stop 12. This can be done in order to ensure that the printing forme 08 will be supplied in the correct lateral register to the mounting position that is intended for it on the forme cylinder 03. To act upon an outside printing forme 07, such as, for example, a printing forme 07 which is assigned to a mounting position on the forme cylinder 03 that is next to an end surface 14 of the forme cylinder 03, an additional stop 16, which is also permanently connected to the storage device, is preferably provided. An outside edge 17 of this outside printing forme 07, which outside edge 17 is aligned parallel with the intended direction of conveyance of the printing forme 07, is laterally aligned in the above-described manner, and also is guided during its infeed process, for example.

In FIG. 1, a printing press machine center 18 and a forme cylinder center 19 are indicated as reference lines. The machine center 18 is the geometric center between the two parallel frame walls 01; 02, which, in this reference system, are considered to be stationary. The cylinder center 19 is a measurement of half the length L of the circumferential surface of the forme cylinder 03 that can be loaded with printing formes 07; 08. In the representation of FIG. 1, an offset V is provided between machine center 18 and cylinder center 19. This offset is the result of the forme cylinder 03 in the example represented in FIG. 1 being positioned closer to the right frame wall 02 than the left frame wall 01. In the preferred embodiment of the present invention, the forme cylinder 03, which is mounted with its journals 04; 06 in the frame walls 01; 02, can be displaced, in its axial direction, relative to the frame walls 01; 02 and also relative to the storage positions of the storage device. This displacement is along an adjustment path which is preferably variably adjustable within set limits. Movement of the forme cylinder 03 along its adjustment path can be accomplished by a translational drive, which is not specifically shown. The displacement of the forme cylinder 03 can therefore be adjusted to different positions between the frame walls 01; 02. A maximum adjustment path, by which the forme cylinder 03 can be displaced axially between the frame walls 01; 02, lies within the range of several millimeters, such as, for example, up to 10 mm. This maximum adjustment path preferably corresponds to the distance A between two adjacent storage positions of the storage device.

Figures 2, 3, 4:
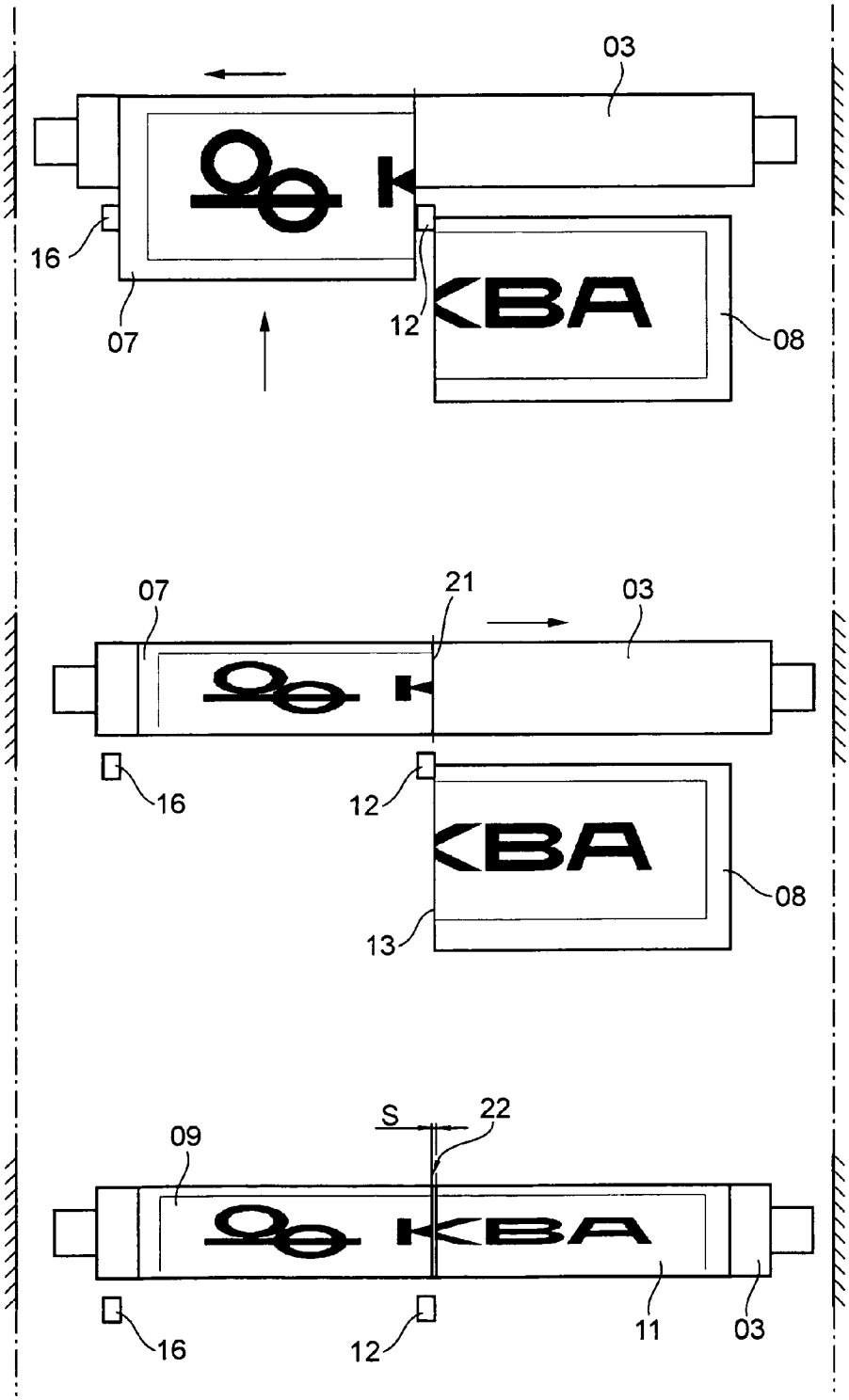
FIG. 2 an arrangement of a first printing forme being situated on the forme cylinder of FIG. 1.
FIG. 3 the forme cylinder of FIG. 1 in an axially modified position.
FIG. 4 an arrangement of a second printing forme situated on the forme cylinder of FIG. 1.

FIG. 2 and FIG. 4 illustrate a variation of the method for arranging printing formes 07; 08 on the forme cylinder 03 represented in FIG. 1 in accordance with the present invention. In this variation, the printing formes 07; 08, which are stored in side-by-side storage positions of the storage device, are supplied individually and successively to their respective mounting positions on the forme cylinder 03. In FIG. 2 through FIG. 4, the respective frame walls 01; 02 of a certain side of the printing press are depicted in alignment with one another. In the example illustrated here, of the two printing formes 07; 08 which are shown in FIGS. 1 through 4, first the "left" printing forme 07 is to be supplied to the forme cylinder 03, followed by the "right" printing forme 08. In order for the "left" printing forme 07 to be supplied to the forme cylinder 03, with its right or inner edge 21, which inner or right edge 21 is aligned parallel to its direction of conveyance, lying at least as close as possible to the cylinder center 19, for example, and despite the presence of the stationary stop 12 that is provided in this area and which is assigned to the "right" printing forme 08, the forme cylinder 03 is displaced axially toward the left, as indicated in FIG. 2 by a left-pointing arrow. Once the forme cylinder 03 has moved to its new position between the frame walls 01; 02, as a result of its axial displacement, the "left" printing forme 07 is conveyed to the forme cylinder 03, as is indicated schematically in FIG. 2 by an arrow which is pointing orthogonally toward the axis 23, as seen in FIG. 1, of the forme cylinder 03. The "left" printing forme 07 is now drawn into its intended mounting position as a result of a rotation of the forme cylinder 03. This "left" printing forme 07 is finally fastened to the circumferential surface of the forme cylinder 03 by one of a positive attachment and/or a non-positive attachment. With the new, left-most axial positioning of the forme cylinder 03, which left-most axial positioning precedes the mounting of the "left" printing forme 07, an offset V which originally existed, for example, between the machine center 18 and the cylinder center 19, as discussed in connection with FIG. 1, can be decreased or can even be eliminated.

Once the "left" printing forme 07 has been drawn onto its intended mounting position on the circumferential surface of the forme cylinder 03, the forme cylinder 03 is axially repositioned, such as, for example, by displacing the forme cylinder 03 toward the right along an adjustment path, as is indicated in FIG. 3 by a right-pointing arrow. An inner or left edge 13 of the "right" printing forme 08, which inner or left edge 13 is aligned with, and/or is guided along the stop 12, comes to rest as close as possible to the right or inner edge 21 of the adjacent "left" printing forme 07, which has already been mounted on the forme cylinder 03. A spacing distance between edges 21 and 13 is kept at a distance of 1 mm or less, when this second or "right" printing forme 08 is supplied to the forme cylinder 03. This very closely spaced arrangement of printing formes 07; 08 on the forme cylinder 08 allows the respective print images 09; 13 of these printing formes 07; 08 to be guided very close to one another. On the substrate to be printed, the optical impression of a print image printed using a panoramic printing forme is created, as may be seen in FIG. 4.

In practice, a gap 22, having a gap width S that is greater than zero, will typically remain between adjacent ones of the printing formes 07; 08 which are mounted on the forme cylinder 03, as depicted in FIG. 4. This small gaps exists because the dimensions of each printing forme 07; 08 are subject to dimensional tolerances as a result of their manufacturing process. Additionally, in one preferred embodiment of the printing formes 07; 08 which may be used in this method, at least the edge 13; 17 that is aligned along one of the stops 12; 16 has been processed by trimming, and is therefore subject to tolerances with respect to its position. Moreover, the existence of a similar small gap between adjacent ones of the printing blankets that are mounted on the transfer cylinder that cooperates with the forme cylinder 03 is important because it is impossible to transfer ink to the print substrate at the position of this gap existing between adjacent printing blankets. Therefore, it makes no sense to locate the print image 09; 13 of one of the printing formes 07; 08 at this position. In any case, however, the displacement of the forme cylinder 03, in accordance with the present invention, results in the arrangement of an additional, subsequently mounted printing forme 08, which is to be arranged on this forme cylinder 03, in a mounting position on the forme cylinder 03 that is adjacent to the mounting position of a previously mounted printing forme 07 already located there, at a distance S that is decreased in relation to the distance A which exists between two adjacent storage positions of the storage device. The gap width S of the gap 22 that remains between two adjacent printing formes 07; 08 measures less than 3 mm, for example, and preferably is approximately 1 mm or less.

In accordance with the method which has been described above, more than two printing formes 07; 08 can also be successively arranged side by side in the axial direction of the forme cylinder 03. The print images 09; 13 which have been applied to these printing formes 07; 08 effectively merge to form a homogeneous whole, and to thus create the impression of a panoramic print image in their imaging on the print substrate. This homogeneous whole image formation is enhanced because the involved printing formes 07; 08 each have a borderless print image 09; 13 which is applied at least along their respective joined edges 13; 21. Once all of the printing formes 07; 08, which will be involved in the panoramic print image, have been arranged on the forme cylinder 03, the axial position of the forme cylinder 03 can be adjusted. The axial positioning of the print images 09; 13 which forme cylinder 03 bears now coincides with the positioning of other print images 09; 13 on at least one other forme cylinder 03 in the same printing press. This image coincidence enables a true-to-size overprinting of the print images 09; 13 on these different forme cylinders 03 on the same print substrate being transported through the printing press.

When a plurality of printing formes 07; 08, such as, for example, two printing formes, are to be arranged on the forme cylinder 03 in its circumferential direction, these printing formes 07; 08 are arranged narrowly circumferentially spaced, one in front of another. Usually, the ends of each printing forme 07; 08, which face one another in the circumferential direction of the forme cylinder 03, once these two printing formes 07; 08 have been arranged on the forme cylinder 03, are bent in a bending apparatus before these printing formes 07; 08 are arranged on the forme cylinder 03. During the arrangement of these printing formes 07; 08 on the forme cylinder 03, these printing forme bent edges are inserted into a slit-type opening that extends axially along the forme cylinder 03. This opening opens up into a groove which extends axially along the forme cylinder 03 beneath its circumferential surface. The slit width of this opening measures less than 5 mm, for example, preferably less than 3 mm, and especially measures only approximately 1 mm. A resultant distance of less than 5 mm, for example, preferably of less than 3 mm, and especially of only approximately 1 mm or less is formed between the respective ends of the two printing formes 07; 08 which may be arranged one in front of another in the circumferential direction of the forme cylinder 03.

Through proper control of the imaging device, the respective print image 09; 13 can be applied quasi edgelessly onto the respective working surfaces of the printing formes 07; 08 which are arranged circumferentially one in front of another. Print images 09; 13 of printing formes 07; 08 which are arranged adjacent each other and also which are arranged one in front of another in the circumferential direction of the forme cylinder 03 create the optical impression of a unified, cohesive print image on the print substrate. Using the method in accordance with the present invention, it is possible to assemble the respective print images 09; 13 of several printing formes 07; 08 arranged side by side in the axial direction of the forme cylinder 03, and also of several printing formes 07; 08 arranged one in front of another in the circumferential direction of the forme cylinder 03, in the manner of a mosaic, to form a unified, cohesive print image. Thus, a group of adjacent printing formes 07; 08, with which the circumferential surface of the forme cylinder 03 is loaded, can optionally be joined together to form a unified, cohesive print image. The respective print images 09; 13 of all of the printing formes 07; 08 which are arranged on the circumferential surface of the forme cylinder 03 can also be assembled to form a unified, cohesive print image when the relevant print images 09; 13 are correspondingly positioned on the working surfaces of their respective printing formes 07; 08 by use of the corresponding control of the imaging device.

The above-described method for arranging printing formes 07; 08 on a forme cylinder 03 of a printing press is preferably fully automated. A control unit, such as, for example, a control panel belonging to the printing press, controls both the axial displacement and the positioning of the relevant forme cylinder 03, and also controls the supply of the relevant printing formes 07; 08 to this forme cylinder 03, when a corresponding control command to form a panoramic print image is issued.

Another embodiment of the method in accordance with the present invention for arranging printing formes 07; 08 on a forme cylinder 03 of a printing press can provide that, in addition to, or alternatively to the displacement of the forme cylinder 03, the storage device can be displaced axially along an adjustment path. As a result of this displacement of the storage device, an additional printing forme 08, that is to be arranged on the forme cylinder 03, is arranged in a mounting position on the forme cylinder 03 that is adjacent to the mounting position of the printing forme 07 which is already located on the forme cylinder 03, and at a distance that is decreased in relation to the distance A between two adjacent storage positions of the storage device. In either embodiment of the present invention, in the above-described method, a lateral relative motion, in the axial direction of the forme cylinder 03, and between the forme cylinder 03 and the storage device occurs. This relative motion or movement is conditioned by the need to decrease the distance A between two adjacent storage positions of the storage device, as printing formes 07; 08 are being arranged on the forme cylinder 03. Accordingly, a relative movement occurs between the forme cylinder 03 and/or the storage device such that, with the relative displacement being executed along an axial adjustment path, a printing forme 08 to be arranged on the forme cylinder 03 is arranged in a mounting position on the forme cylinder 03 that is adjacent to the mounting position of another printing forme 07, which preferably is already located there or will be located there, at a distance that is reduced or decreased in relation to the distance A between two adjacent storage positions of the storage device.

While preferred embodiments of a method for arranging printing formes on a forme cylinder of a printing press, in accordance with the present invention, have been set forth fully and completely hereinabove, it will be apparent to one of skill in the art that various changes could be made in the structure of the storage device, in the structure of the forme cylinder and in the structures of the inking and/or dampening units without departing from the true spirit and scope of the present invention, which is accordingly to be limited only by the appended claims.

What is claimed is:

1. A method for arranging printing formes on a forme cylinder of a printing press including:

arranging a plurality of printing forme mounting positions located side by side in an axial direction of said forme cylinder and being usable for each receiving one of said printing formes;

providing a storage device having a plurality of storage positions which are arranged side by side in said axial direction of said forme cylinder;

storing each of said printing formes in one of said plurality of storage positions before being arranged in one of said mounting positions;

spacing said plurality of storage positions from each other at a fixed distance;

displacing at least one of said forme cylinder and said storage device relative to one another along an adjustment path in said axial direction of said forme cylinder;

causing a printing forme stored in one of said plurality of storage positions to be arranged in one of said plurality of printing forme mounting positions in response to said displacing of said at least one of said forme cylinder and said storage device along said adjustment path; and locating said one of said plurality of printing forme mounting positions adjacent a mounting position of another one of said plurality of printing formes to be mounted on said forme cylinder at a decreasing distance which is less than said fixed distance between two adjacent ones of said plurality of storage positions of said storage device.

2. The method of claim 1 including providing an imaging device and using said imaging device to apply a print image to each one of said plurality of printing formes which are to be arranged adjacent to one another on said forme cylinder at said decreased distance as compared with said fixed distance between two adjacent ones of said printing forme storage positions and locating said print images on said printing formes to be mounted adjacent each other on said forme cylinder with each such print image extending up to an edge of said respective printing forme, said edge facing a respective other printing forme to be arranged at said decreasing distance.

3. The method of claim 2 further including providing at least one stop in said printing forme storage device and using said stop for aligning said edge of said respective printing forme to be mounted on said forme cylinder adjacent said respective other printing forme at said decreased distance during one of prior to and during supply of said respective printing forme to said storage device.

4. The method of claim 3 further including using said stop belonging to said storage device for guiding said edge of said respective printing forme that faces said respective other printing forme that is to be arranged adjacent to it at said decreased distance.

5. The method of claim 3 further including arranging a plurality of said printing formes circumferentially on said forme cylinder.

6. The method of claim 5 further including selectively arranging one of four, six and eight of said printing formes side by side on said plurality of printing forme mounting positions located in said axial direction and arranging at least two of said printing formes one in front of another circumferentially in said mounting positions of said cylinder which are arranged side by side axially.

7. The method of claim 5 further including arranging said plurality of said printing formes circumferentially mounted adjacent one another on said forme cylinder in its circumferential direction having a distance of less than 3 mm between respective ends of said circumferentially arranged printing formes.

8. The method of claim 7 further including providing said circumferential mounted printing forme distance less than 1 mm between said respective ends.

9. The method of claim 2 further including imaging each of said printing formes to be arranged on said forme cylinder with a print image using said imaging device prior to their being arranged on said forme cylinder and for selecting a positioning of said respective print image on a working surface of said respective said printing forme by controlling said imaging device.

10. The method of claim 9 further including one of applying said print image to a group of said printing formes to be arranged adjacent to one another on respective working surfaces for said forme cylinder and applying said print images to respective working surfaces of all of said printing formes to be arranged on said forme cylinder by controlling said imaging device such that said individual print images belonging to said one of said group of printing formes and all of said printing formes are assembled for forming a unified print image in a mosaic fashion.

11. The method of claim 2 further including controlling said imaging device using data from a preprint stage.

12. The method of claim 1 further including mounting more than first and second of said printing formes on said forme cylinder at said decreasing distance which is less than said fixed distance between two adjacent ones of said plurality of storage positions of said storage device.

13. The method of claim 1 further including placing said storage positions of said storage device, each of which stores one of said printing formes, in functional connection with said mounting positions of said forme cylinder.

14. The method of claim 1 further including axially displacing said forme cylinder prior to supplying said first printing forme to said forme cylinder.

15. The method of claim 1 further including axially displacing said forme cylinder path after a last one of said printing formes to be arranged side by side on said forme cylinder has been supplied to it.

16. The method of claim 1 further including providing a control unit and using said control unit for performing automatically said displacement and positioning of at least one of said forme cylinder and said storage device along said adjustment path, and for supplying said printing formes for side by side arrangement on said forme cylinder.

17. The method of claim 16 further including initiating said automatic performing of said axial displacement and positioning of at least one of said forme cylinders and said storage device and for supplying said printing formes for side by side arrangement on said forme cylinder by supplying a control command to said control unit for forming a panoramic print image.

18. The method of claim 1 further including arranging said printing formes adjacent to one another on said forme cylinder in said axial direction having a gap between edges of said adjacent ones of said printing formes, said gap having a gap width of less than 3 mm.

19. The method of claim 18 further including providing said gap having said gap width of less than 1 mm.

20. The method of claim 1 further including conveying each said printing forme stored in one of said storage positions of said storage device to one of said mounting positions on said forme cylinder intended for it orthogonally with respect to an axis of said forme cylinder.

21. The method of claim 1 further including using a rotational movement of said forme cylinder for drawing each of said printing formes to be arranged on said forme cylinder into its intended mounting position on said forme cylinder.

22. The method of claim 1 further including using one of a positive attachment and a non-positive attachment for fastening each of said printing formes to be arranged on said forme cylinder to a circumferential surface of said forme cylinder.

23. The method of claim 1 further including displacing said storage device having said plurality of storage positions, each of which stores one of said printing formes, laterally relative to said forme cylinder before supplying said first printing forme to said forme cylinder.

24. The method of claim 1 further including implementing said printing press as a newspaper printing press.

25. The method of claim 1 further including implementing said printing press for operating using an offset printing process.

* * * * *